US011440315B2

(12) United States Patent
Mawatari et al.

(10) Patent No.: US 11,440,315 B2
(45) Date of Patent: Sep. 13, 2022

(54) INK JET RECORDING APPARATUS AND INK JET RECORDING METHOD

(71) Applicant: KONICA MINOLTA, INC., Tokyo (JP)

(72) Inventors: Kenji Mawatari, Musashino (JP); Masanori Shimazoe, Hino (JP); Ryohei Kobayashi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 689 days.

(21) Appl. No.: 16/328,341

(22) PCT Filed: Aug. 9, 2017

(86) PCT No.: PCT/JP2017/028873
§ 371 (c)(1),
(2) Date: Feb. 26, 2019

(87) PCT Pub. No.: WO2018/043074
PCT Pub. Date: Mar. 8, 2018

(65) Prior Publication Data

US 2021/0283905 A1 Sep. 16, 2021

(30) Foreign Application Priority Data

Aug. 31, 2016 (JP) ..... JP2016-169094

(51) Int. Cl.
*B41J 2/045* (2006.01)

(52) U.S. Cl.
CPC ..... *B41J 2/04516* (2013.01); *B41J 2/04581* (2013.01); *B41J 2/04588* (2013.01); *B41J 2/04596* (2013.01)

(58) Field of Classification Search
CPC ..... B41J 2/04581; B41J 2/04595; B41J 2/14233; B41J 2/04516
See application file for complete search history.

(56) References Cited

U.S. PATENT DOCUMENTS 5,285,215 A * 2/1994 Liker ..... B41J 2/04581 347/11
6,488,349 B1 12/2002 Matsuo et al.
(Continued)

FOREIGN PATENT DOCUMENTS

| | | | |
|---|---|---|---|
| JP | S59133066 | A | 7/1984 |
| JP | 2001146011 | A | 5/2001 |
| WO | 9808687 | A1 | 3/1998 |

OTHER PUBLICATIONS

JPO Notice of Reasons for Refusal for JP Application No. 2018-537088; dated Nov. 4, 2020.
(Continued)

*Primary Examiner* — Lam S Nguyen
(74) *Attorney, Agent, or Firm* — Cantor Colburn LLP

(57) ABSTRACT

There is provided an ink jet recording apparatus including an ink jet head and a drive circuit. The ink jet head forms an image on a recording medium in response to a drive signal applied to multiple piezoelectric elements. The drive signal causes multiple pressure chambers corresponding to the multiple piezoelectric elements to expand or to contract in volume and causes ink in the multiple pressure chambers to be discharged from multiple nozzles. The drive circuit generates a drive signal for discharging multiple liquid droplets to one pixel for combining the multiple liquid droplets together and applies the drive signal to each of the multiple piezoelectric elements of the ink jet head. The drive signal includes multiple discharge pulses which make velocities of tips of respective liquid columns substantially same after a predetermined time from starting of ink discharge from the nozzles.

12 Claims, 6 Drawing Sheets

(56) References Cited

U.S. PATENT DOCUMENTS

| | | | |
|---|---|---|---|
| 2007/0182774 | A1 | 8/2007 | Iriguchi |
| 2008/0266338 | A1 | 10/2008 | Koseki et al. |
| 2009/0289982 | A1 | 11/2009 | Hasenbein |
| 2009/0289983 | A1 | 11/2009 | Letendre, Jr. et al. |
| 2012/0218333 | A1 | 8/2012 | Nishikawa |

OTHER PUBLICATIONS

EPO Office Action for corresponding EP Application No. 17846083.8; dated Jul. 16, 2020.
International Search Report corresponding to Application No. PCT/JP2017/028873; dated Oct. 17, 2017.
CNIPA First Office Action corresponding to CN Application No. 201780052104.9 dated Feb. 6, 2020.
International Preliminary Report on Patentability corresponding to Application No. PCT/JP2017/028873; dated Mar. 5, 2019.
Extended European Search Report corresponding to Application No. 17846083.8-1019/3508344 PCT/JP2017028873; dated Aug. 6, 2019.

* cited by examiner

INK JET RECORDING APPARATUS AND INK JET RECORDING METHOD

CROSS REFERENCE TO RELATED APPLICATIONS

The present U.S. Patent Application is U.S. National Phase Application under 35 U.S.C. 371 of International Application PCT/JP2017/028873 filed on Aug. 9, 2017. This application claims a priority under the Paris Convention of Japanese Patent Application No. 2016-169094 filed on Aug. 31, 2016, the entire disclosure of which is incorporated herein by reference in its entirety.

TECHNICAL FIELD

The present invention relates to an ink jet recording apparatus and an ink jet recording method.

BACKGROUND ART

Conventionally, there has been known an ink jet recording apparatus such as an ink jet printer which forms an image on a recording medium by discharging ink (droplets) from a nozzle of an ink jet head. As a method of applying shading to an image by an ink jet recording apparatus, a multi-drop method is known in which multiple droplets are discharged to one pixel in order to realize discharging liquid in multiple steps.

For example, a known ink jet recording apparatus generates driving pulses to form multiple droplets to be discharged among which a droplet discharged later is discharged at a higher velocity than a droplet discharged earlier and to combine the multiple droplets into one droplet at ejection, and supplies the driving pulses to an piezoelectric element of an ink jet head (see Patent Document 1).

CITATION LIST

Patent Literature

[Patent Document 1] Japanese Patent Application Laid Open Publication No. 2001-146011

SUMMARY OF INVENTION

Technical Problem

The ink discharged from the nozzle of the ink jet head is discharged as a liquid column first and then flies as a droplet(s). It has been known that, due to separation or the like, the liquid column flies as a main droplet with a satellite (satellite droplet(s)) following the main droplet. The satellite is more likely to be formed when the droplet is discharged at higher velocity.

According to the ink jet recording apparatus according to patent document 1, since the later driving pulse is generated such that a droplet is discharged at higher velocity, image quality of a recorded image is degraded due to the satellite readily formed by the pulse for discharging the last droplet.

Objects of the present invention according to at least one aspect include reduction of the satellite and improvement of image quality of a recorded image.

Solution to Problem

To achieve at least one of the abovementioned objects, according to an aspect of the present invention, the invention described in claim 1 comprises:

an ink jet head which forms an image on a recording medium in response to a drive signal applied to multiple piezoelectric elements, the drive signal causing multiple pressure chambers corresponding to the multiple piezoelectric elements to expand or to contract in volume and causing ink in the multiple pressure chambers to be discharged from multiple nozzles; and a drive circuit which generates a drive signal for discharging multiple liquid droplets to one pixel for combining the multiple liquid droplets together and applies the drive signal to each of the multiple piezoelectric elements of the ink jet head, wherein the drive signal includes multiple discharge pulses which make velocities of tips of respective liquid columns substantially same after a predetermined time from starting of ink discharge from the nozzles.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DESCRIPTION OF EMBODIMENTS

Figure 1:
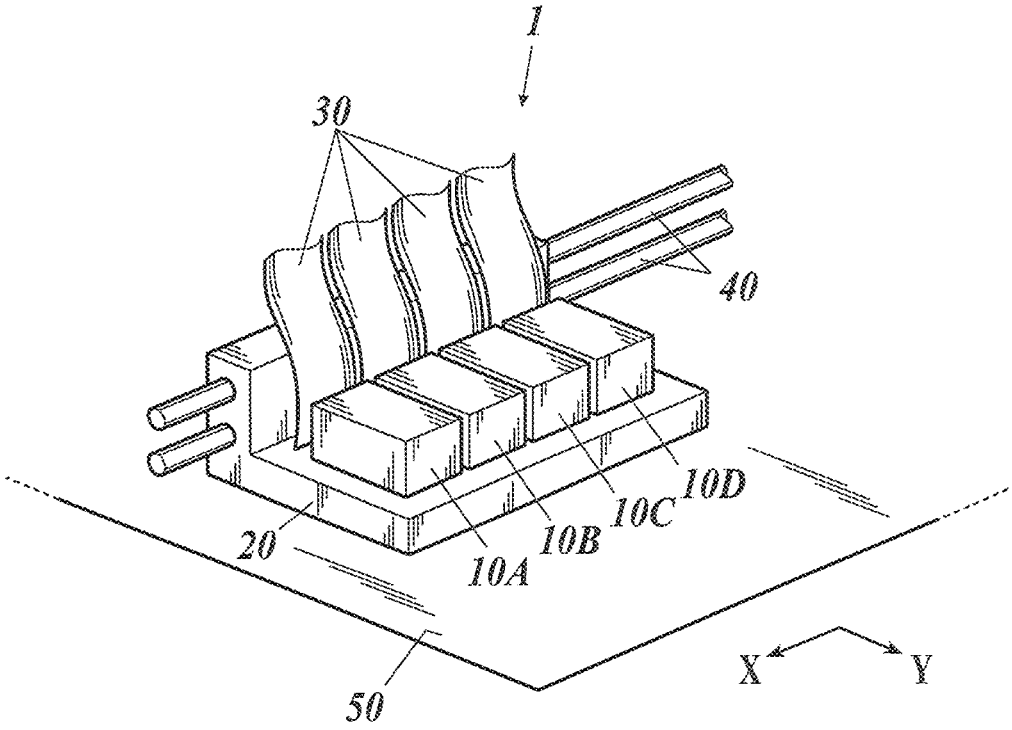
FIG. 1 is a schematic diagram showing an ink jet recording apparatus of an embodiment according to the present invention.

Hereinafter, one or more embodiments of the present invention will be described with reference to the drawings. However, the scope of the invention is not limited to the disclosed embodiments.

An embodiment of the present invention will be explained with reference to the attached drawings. The present invention is not limited to the examples shown in the drawings.

Figure 2:
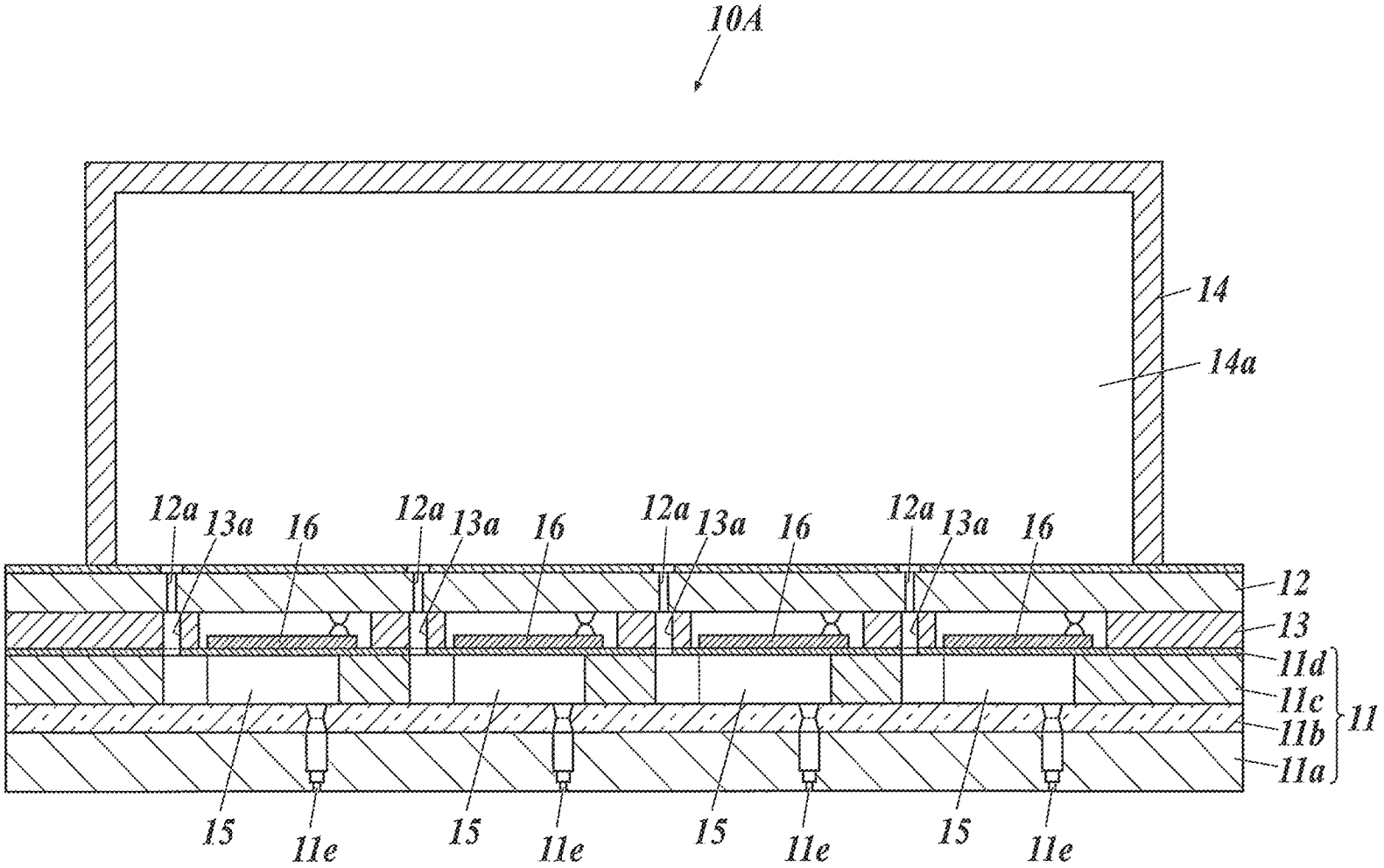
FIG. 2 is a cross-sectional view of the ink jet head.
Figure 3:
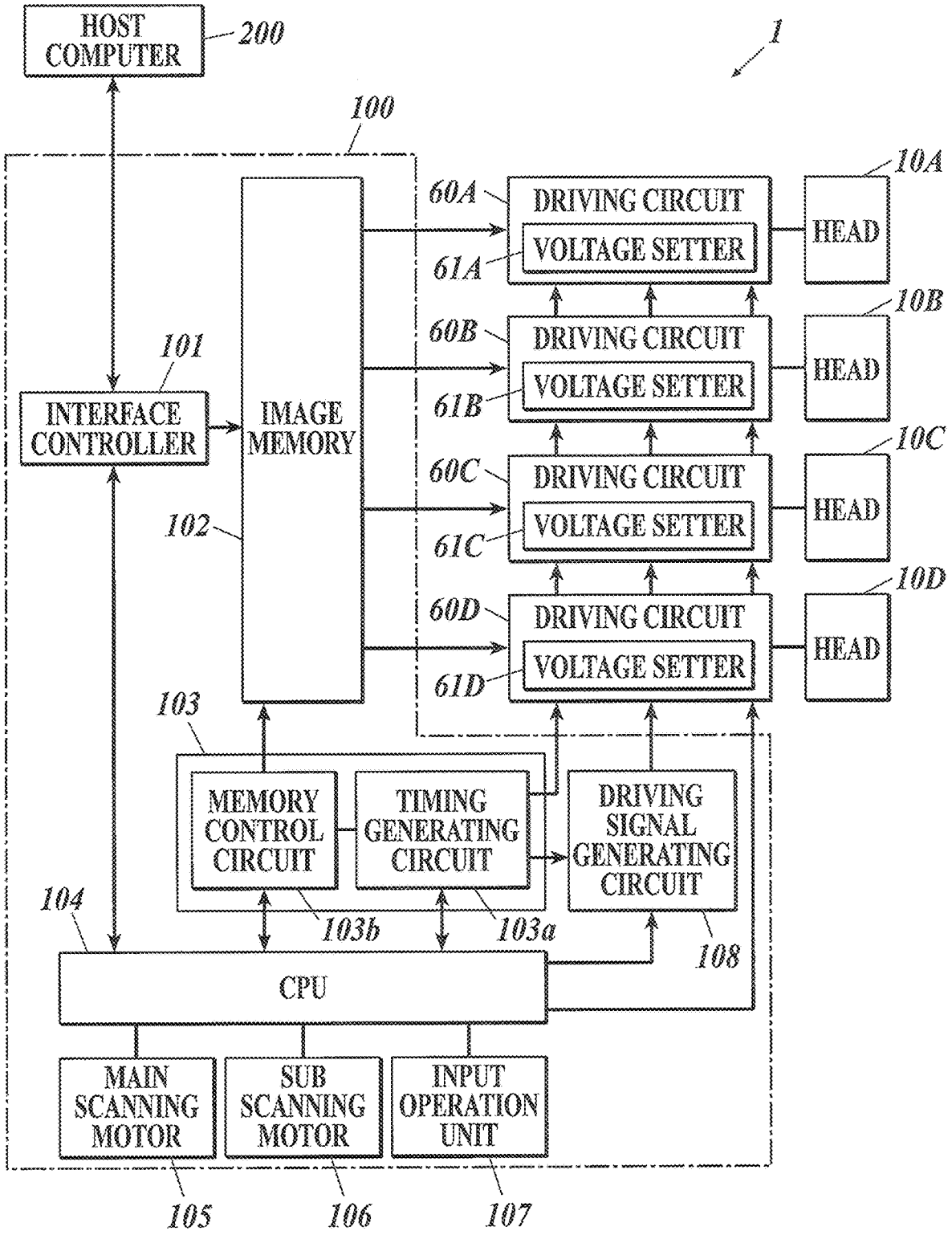
FIG. 3 is a block diagram of an electrical configuration of the ink jet recording apparatus.

With reference to FIG. 1 to FIG. 3, an apparatus configuration of the ink jet recording apparatus 1 of the present embodiment will be explained. First, with reference to FIG. 1, the overall configuration of the ink jet recording apparatus 1 will be explained. FIG. 1 is a schematic diagram showing an embodiment of an ink jet recording apparatus of the present invention.

As shown in FIG. 1, the ink jet recording apparatus 1 includes four ink jet heads 10A, 10B, 10C, and 10D. In the present embodiment, the four ink jet heads 10A to 10D each for ink colors of Y (yellow), M (magenta), C (cyan), and K (black) are arranged in parallel in the X direction (main scanning direction) in the drawing, however, the number of ink jet heads is not limited to four.

Each of the ink jet heads 10A to 10D is mounted on a common carriage 20 such that the nozzle surface side faces a recording medium 50, and is electrically connected to a control device provided in the ink jet recording apparatus 1 (not shown in the drawing) via a flexible cable 30.

The carriage 20 can reciprocate along the main scanning direction which is along the guide rail 40 by a main scanning motor (not shown in FIG. 1). The recording medium 50 is driven by of a sub-scanning motor (not shown in FIG. 1) to be intermittently conveyed by a predetermined amount along the Y direction in the drawing which is orthogonal to the main scanning direction.

The ink jet recording apparatus 1 discharges ink from the nozzle of the each of the ink jet heads 10A to 10D toward the recording medium 50 during the process in which each of the ink jet heads 10A to 10D moves in the main scanning direction by the movement of the carriage 20. By cooperation of movement of the ink jet heads 10A to 10D in the main scanning direction and the intermittent conveyance of the recording medium 50 in a sub-scanning direction, a predetermined image is printed on the recording medium 50.

Next, the configurations of the ink jet heads 10A to 10D will be explained with reference to FIG. 2. FIG. 2 is a cross-sectional view of the ink jet head 10A. Since each of the ink jet heads 10A to 10D has the same configuration, the configuration of the ink jet head 10A in FIG. 2 will be explained as a representative example.

The ink jet head 10A includes a head substrate 11, a wiring substrate 12, and an adhesive resin layer 13. The head substrate 11, the adhesive resin layer 13, and the wiring substrate 12 are stacked in this order from the lower layer side in the figure. An ink manifold 14 is bonded to the upper face of the wiring substrate 12. The interior of the ink manifold 14 is a common ink chamber 14*a* in which ink is stored between the ink manifold 14 and the wiring substrate 12.

The head substrate 11 includes a nozzle plate 11*a* formed of a Si (silicon) substrate, an intermediate plate 11*b* formed of a glass substrate, a pressure chamber plate 11*c* formed of a Si (silicon) substrate, and a diaphragm 11*d* formed of a $SiO_2$ thin film. The nozzle plate 11*a*, the intermediate plate 11*b*, the pressure chamber plate 11*c*, and the diaphragm 11*d* are stacked in order from the lower layer side in the drawing. Multiple nozzles 11*e* are open on the lower face of the nozzle plate 11*a*.

The pressure chamber plate 11*c* has multiple pressure chambers 15 in which ink is stored. The upper wall of the pressure chambers 15 is constituted by a diaphragm 11*d*, and the lower wall is constituted by an intermediate plate 11*b*. Each pressure chamber 15 communicates with a nozzle 11*e* via an intermediate plate 11*b*.

On the upper face of the diaphragm 11*d*, actuators 16 are stacked on the pressure chambers 15 one by one. The actuator 16 has a structure in which a piezoelectric element such as a thin film PZT (lead zirconate titanate) is sandwiched between an upper electrode and a lower electrode (both not shown) as drive electrodes. The upper electrode is arranged on the upper face of the main body of the actuator 16, and the lower electrode is arranged on the lower face of the piezoelectric element. The lower electrode spreads over the upper face of the diaphragm 11*d* and constitutes a common electrode which is common to all the actuators 16. The lower electrode is grounded.

The wiring substrate 12 is a substrate provided with wirings for applying drive signals from the drive circuits (not shown in FIG. 1 and FIG. 2) provided for the respective ink jet heads 10A to 10D to the drive electrodes of the respective actuators 16.

The adhesive resin layer 13 is formed of, for example, a thermosetting photosensitive adhesive resin sheet, and between the head substrate 11 and the wiring substrate 12 to integrally adhere the substrates 11 and 12. A gap corresponding to the thickness of the adhesive resin layer 13 is formed between the head substrate 11 and the wiring substrate 12. The area of the adhesive resin layer 13 corresponding to the actuator 16 and its surroundings is removed by exposure and development. The actuators 16 are arranged in respective spaces formed by removing the adhesive resin layer 13.

Through holes 13*a* vertically penetrating the adhesive resin layer 13 are formed corresponding to the respective pressure chambers 15. One end (upper end) of each through hole 13*a* communicates with an ink supply path 12*a* formed in the wiring substrate 12. The other end (lower end) communicates with the inside of the pressure chamber 15. The ink supply path 12*a* is open to the common ink chamber 14*a*.

In the ink jet head 10A, ink is supplied into each of the pressure chamber 15 from the common ink chamber 14*a* via the ink supply path 12*a* and the through hole 13*a*. When a drive signal including an expansion pulse and a contraction pulse is applied from the drive circuits to the drive electrodes of the respective actuators 16 as described later, the diaphragm 11*d* vibrates due to deformation of the actuators 16, and so as to cause the corresponding pressure chamber 15 to expand and contract in volume. As a result, the pressure of ink in the pressure chamber 15 changes, and the ink is discharged from the nozzle 11*e* toward the recording medium 50.

Next, with reference to FIG. 3, an electrical configuration of the ink jet recording apparatus 1 will be explained. FIG. 3 is a block diagram of an electrical configuration of the ink jet recording apparatus 1.

As shown in FIG. 3, the ink jet recording apparatus 1 is electrically connected to the host computer 200. The ink jet recording apparatus 1 includes a controller 100, ink jet heads 10A, 10B, 10C, and 10D, and drive circuits 60A, 60B, 60C, and 60D respectively correspond to the ink jet heads 10A, 10B, 10C, and 10D.

The controller 100 includes an interface controller 101, an image memory 102, a transfer unit 103, a CPU (Central Processing Unit) 104, a main scanning motor 105, a sub-scanning motor 106, an input operation unit 107, a drive signal generation circuit 108, and the like.

The interface controller 101 receives image information on an image to be printed on the recording medium 50 from a host computer 200 connected via a communication line.

The image memory 102 temporarily stores the image information received via the interface controller 101. The image information of the image memory 102 is input to the drive circuits 60A, 60B, 60C, and 60D.

From the image memory 102 to each of the drive circuits 60A, 60B, 60C, and 60D, the transfer unit 103 transfers information on a partial image to be recorded by one discharge from multiple nozzles of each of the ink jet heads 10A, 10B, 10C, and 10D. The transfer unit 103 includes a timing generation circuit 103*a* and a memory control circuit 103*b*. The timing generation circuit 103*a* obtains position information of the carriage 20 by, for example, an encoder sensor (not shown) or the like. From the position information, the memory control circuit 103*b* obtains the address of the partial image information required for each of the ink jet heads 10A, 10B, 10C, and 10D. Using the address of the partial image information, the memory control circuit 103*b* performs reading from the image memory 102 and transferring to the driving circuits 60A, 60B, 60C, and 60D.

The CPU 104 is a controller unit which controls the ink jet recording apparatus 1 and controls conveyance of the recording medium 50, movement of the carriage 20, ink discharge from the respective ink jet heads 10A to 10D, and the like.

The main scanning motor 105 is a motor for moving the carriage 20 shown in FIG. 1 in the main scanning direction. The sub-scanning motor 106 is a motor for conveying the recording medium 50 in the sub-scanning direction. The CPU 104 controls driving of the main scanning motor 105 and the sub-scanning motor 106.

The input operation unit 107 is a unit from which the CPU 104 receives various input operations by the operator, and is configured as, for example, a touch panel.

The driving signal generating circuit 108 generates a signal waveform of a driving signal for discharge of ink from the ink jet heads 10A to 10D. This signal waveform is in synchronization with latch signals of the image information of the timing generation circuit 103*a*, is generated for each latch signal, and is output to the drive circuits 60A to 60D.

The drive circuits 60A, 60B, 60C, and 60D drive the respective actuators 16 of the corresponding ink jet heads 10A, 10B, 10C, and 10D. The drive circuits 60A, 60B, 60C, and 60D are mounted on the carriage 20 together with the ink jet heads 10A to 10D, and are electrically connected to the controller 100 by the flexible cables 30.

The drive circuits 60A, 60B, 60C, and 60D have voltage setting units 61A, 61B, 61C, and 61D, respectively. The voltage setting units 61A, 61B, 61C, and 61D set predetermined voltages with respect to the signal waveform of the driving signal input from the driving signal generating circuit 108. Based on the image information sent from the image memory 102, the drive circuits 60A, 60B, 60C, and 60D each apply the driving signals whose voltages have been set by the voltage setting units 61A, 61B, 61C, and 61D to the driving electrode(s) of the actuator 16 of the corresponding ink jet heads 10A, 10B, 10C, and 10D. The CPU 104 may be able to control the voltage values set by the voltage setting units 61A, 61B, 61C, and 61D independently for the respective driving circuits 60A, 60B, 60C, and 60D.

Figure 4:
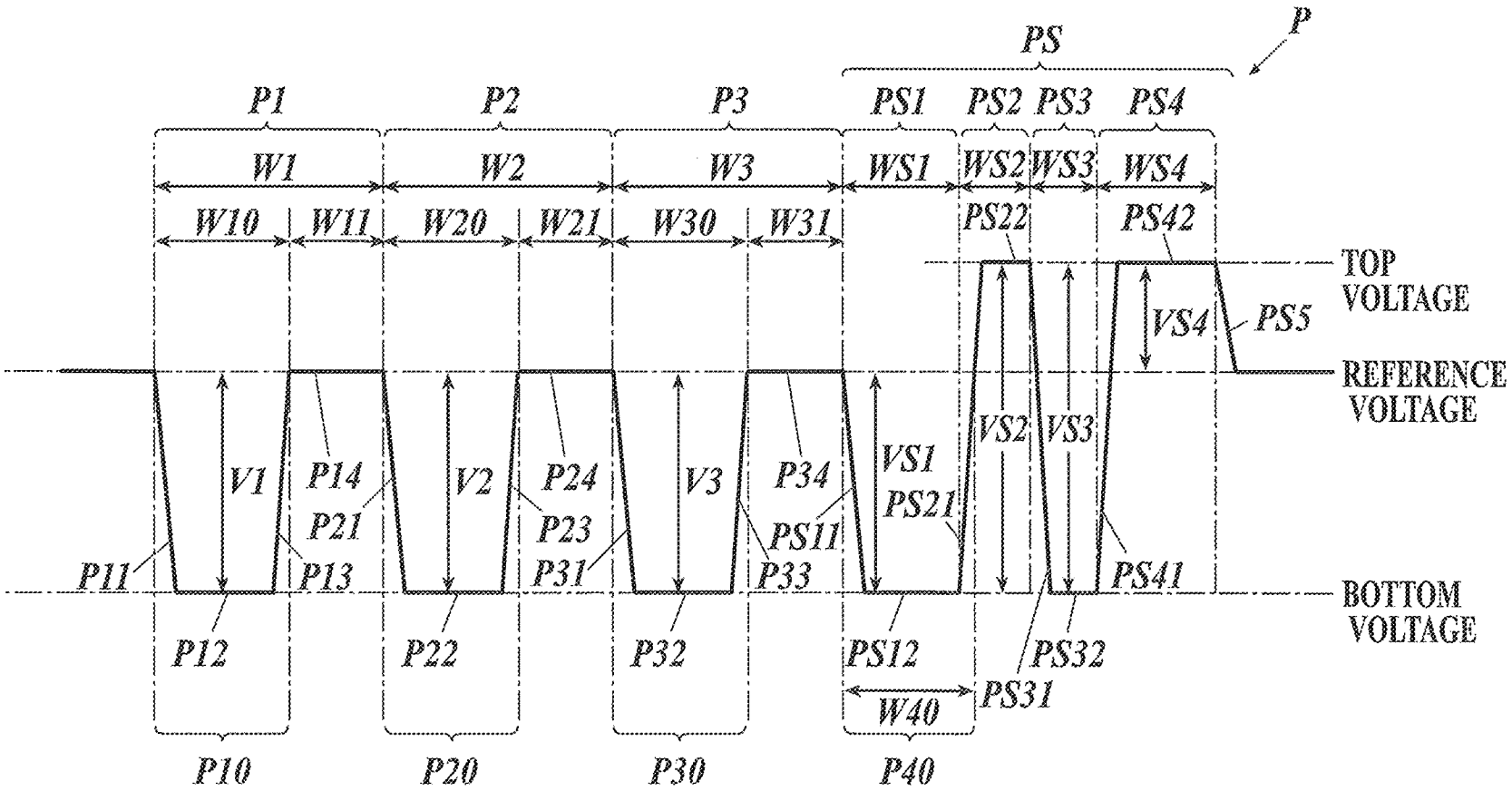
FIG. 4 is a timing chart showing a waveform of drive signal input to an ink jet head from a drive circuit.

Next, the drive signal P will be explained with reference to FIG. 4. FIG. 4 is a timing chart showing a waveform of drive signal P input to the ink jet heads 10A, 10B, 10C, and 10D from the drive circuits 60A, 60B, 60C, and 60D. In FIG. 4, voltage is plotted on the vertical axis and time is plotted on the horizontal axis. The same applies to the timing charts of the other figures.

The drive signal P is a driving pulse for a multi-drop system, for example, for discharging four droplets in one pixel and combining them together.

The drive signal P includes, starting from a reference voltage in order, a first discharge pulse P1 for discharging the first liquid droplet, a second discharge pulse P2 for discharging the second droplet, a third discharge pulse P3 for discharging the third droplet, and a fourth discharge pulse PS for discharging a fourth droplet as a satellite reducing pulse for reducing the satellite(s). The reference voltage is a voltage which is applied when no waveform is input to the ink jet heads 10A to 10D, and which makes the pressure chambers 15 in a standby state where the pressure chambers 15 contract by a predetermined amount of volume. The top voltage is the highest voltage of each pulse of the vibrating driving signal P and the bottom voltage is the lowest voltage of each pulse of the vibrating the driving signal P. The bottom voltage is the lowest voltage, ideally 0 [V], but due to the circuit configuration, a voltage having a predetermined value such as 1 [V]. Since the pressure difference from other voltages is important in the drive signal, the bottom voltage may be 5, 10 [V] or the like.

The number of droplets discharged onto one pixel by the driving signal P is not limited to four, and may be other numbers of two or more. For example, the driving signal may sequentially include one, two, or four or more discharge pulses substantially similar to the first discharge pulse P1 and a discharge pulse PS for reducing the satellite similar to the fourth discharge pulse PS.

The first discharge pulse P1 sequentially includes an expansion pulse P11 for causing the pressure chambers 15 to expand in volume, a maintenance pulse P12 for maintaining the voltage at the bottom voltage of the expansion pulse P11, a contraction pulse P13 for causing the pressure chambers 15 to contract in volume to discharge ink from the nozzles 11*e*, and a maintenance pulse P14 for maintaining the voltage at the reference voltage as the top voltage of the contraction pulse P13.

As the first discharge pulse P1, the second discharge pulse P2 sequentially includes an expansion pulse P21, a maintenance pulse P22, a contraction pulse P23, and a maintenance pulse P24. As the first discharge pulse P1, the third discharge pulse P3 sequentially includes an expansion pulse P31, a maintenance pulse P32, a contraction pulse P33, and a maintenance pulse P34.

The temporal pulse width of the first discharge pulse P1 is set as a pulse width W1. The temporal pulse width of the second discharge pulse P2 is set as a pulse width W2. The temporal pulse width of the third discharge pulse P3 is set as a pulse width W3. A potential difference between the bottom voltage and the reference voltage for the first discharge pulse P1 (discharge pulse P10) is set as a voltage V1. A potential difference between the bottom voltage and the reference voltage for the second discharge pulse P2 (discharge pulse P20) is set as a voltage V2. A potential difference between the bottom voltage and the reference voltage for the third discharge pulse P3 (discharge pulse P30) is set as a voltage V3.

Further, the expansion pulse P11, the maintenance pulse P12, and the contraction pulse P13 are set as the discharge pulse P10 for substantially discharging a droplet. The maintenance pulse P14 is set as a droplet discharge standby time (rest time) corresponding to the discharge pulse P10. The temporal pulse width of the discharge pulse P10 is set as a pulse width W10, and the temporal pulse width of the maintenance pulse P14 is set as a pulse width W11. Similarly, the temporal pulse width of the discharge pulse P20 including the expansion pulse P21, the maintenance pulse P22, and the contraction pulse P23 is set as a pulse width W20, and the temporal pulse width of the maintenance pulse P24 as a pulse width W21. Similarly, the temporal pulse width of the third discharge pulse P30 including the expansion pulse P31, the maintenance pulse P32, and the contraction pulse P33 is set as a pulse width W30, and the temporal pulse width of the maintenance pulse P34 as a pulse width W31.

The fourth discharge pulse PS sequentially includes, starting from the reference voltage at the end of the third discharge pulse, a first expansion pulse PS1 for causing the pressure chambers 15 to expand in volume, a first contraction pulse PS2 for causing the pressure chambers 15 to contract in volume to discharge ink from the nozzles 11*e*, a second expansion pulse PS3 for causing the pressure chambers 15 to expand in volume, a second contraction pulse PS4 for causing the pressure chambers 15 to contract in volume, and a pulse PS5 for returning to the reference voltage from the top voltage of the second contraction pulse PS4.

The temporal pulse width of the first expansion pulse PS1 is set as a pulse width WS1. The temporal pulse width of the first contraction pulse PS2 is set as a pulse width WS2. The temporal pulse width of the second expansion pulse PS3 is set as a pulse width WS3. The temporal pulse width of the second contraction pulse PS4 is set as a pulse width WS4.

The first expansion pulse PS1 includes an expansion pulse PS11 for lowering the voltage from the reference voltage to the bottom voltage, and a maintenance pulse PS12 for maintaining the voltage at the bottom voltage of the expansion pulse PS11.

Further, the first contraction pulse PS2 includes a contraction pulse PS21 for increasing the voltage from the bottom voltage of the first expansion pulse PS1 to the top voltage, and a maintenance pulse PS22 for maintaining the voltage at the top voltage of the contraction pulse PS21. The top voltage of the first contraction pulse PS2 is a predetermined voltage larger than the reference voltage. The second expansion pulse PS3 includes an expansion pulse PS31 for lowering the voltage from the top voltage of the first contraction pulse PS2 to the bottom voltage, and a maintenance pulse PS32 for maintaining the voltage at the bottom voltage of the expansion pulse PS31. The second contraction pulse PS4 includes a contraction pulse PS41 for increasing the voltage from the bottom voltage of the second expansion pulse PS3 to the top voltage, and a maintenance pulse PS42 for maintaining the voltage at the top voltage of the contraction pulse PS41.

Although the maintenance pulses PS12, PS22, PS32, and PS42 are flat pulses In the present embodiment, they are not necessarily limited to flat pulses but be inclined slightly upward as long as there is no problem in ink discharge.

The first expansion pulse PS1 and the pulse from the bottom voltage to the reference voltage for the contraction pulse PS21 of the first contraction pulse PS2 are set as a discharge pulse P40, and the temporal pulse width of the discharge pulse P40 is set as a pulse width W40.

A potential difference between the reference voltage and the bottom voltage of the first expansion pulse P1S is set as a voltage VS1. A potential difference between the lowest voltage of the first contraction pulse PS2 (start voltage) and the top voltage of the first expansion pulse PS2 is set as a voltage VS2. A potential difference between the highest voltage of the second expansion pulse PS3 (start voltage) and the bottom voltage is set as a voltage VS3. A potential difference between the top voltage of the second contraction pulse PS4 and the reference voltage is set as a voltage VS4.

The drive signal P described in this embodiment has a slope waveform in which the rising and falling edges of the respective discharge pulses P1, P2, P3, and PS (PS1, PS2, PS3, PS4, and PS5) are inclined. The slope waveform is preferably adopted in the embodiment of the present invention since it has an effect of reducing unstable discharge due to the satellite, velocity abnormality, bending, etc.

Here, the discharge of ink by the ink jet heads 10A, 10B, 10C, and 10D will be explained. First, in order to cause multiple droplets to land on the same pixel, the ink jet heads 10A, 10B, 10C, and 10D are moved to positions corresponding to the pixel. When the drive signal P is applied to the drive electrodes of the actuators 16 of the ink jet heads 10A, 10B, 10C, and 10D, the pressure chambers 15 in the standby state starts to expand in volume due to the expansion pulse P11 of the first discharge pulse P1. As a result, ink flows into the pressure chambers 15 from the common ink chamber 14*a*. This expanding state is maintained during the maintenance pulse P12.

Then, due to the contraction pulse P13, the pressure chambers 15 in the expanding state starts to contract in volume. As the pressure chambers 15 contract, positive pressure waves are generated in the pressure chambers 15. As a result, the ink is pushed out from the nozzles 11*e*, and the meniscus comes out of the nozzles 11*e*. This contracting state is maintained during the maintenance pulse P14.

Then, due to the expansion pulse P21 of the second discharge pulse P2, the pressure chambers 15 starts to expand in volume again. Due to the expansion pulse P21 of the second discharge pulse P2, the meniscus pushed out from the nozzles 11*e* is retracted toward the nozzles 11*e*. As a result, ink is discharged as a liquid droplet having a columnar shape from the nozzles 11*e* due to the contraction pulse P13.

Similarly, second and third liquid droplets are sequentially discharged from the nozzles 11*e* due to the second discharge pulse P2 and the third discharge pulse P3.

Then, due to the expansion pulse PS11 of the first expansion pulse PS1 of the fourth discharge pulse PS, the pressure chambers 15 in the standby state start to expand in volume. As a result, ink flows into the pressure chambers 15 from the common ink chamber 14*a*. This expanding state is maintained during the maintenance pulse PS12.

Then, due to the contraction pulse PS21 of the first contraction pulse PS2, the pressure chambers 15 in an expanded state start to contract in volume. Due to the contraction of the pressure chambers 15 in volume, positive pressure waves are generated in the pressure chambers 15. As a result, the ink is pushed out from the nozzles 11*e*, and the fourth ink is discharged. This contracting state is maintained during the maintenance pulse PS22.

Then, due to the expansion pulse PS31 of the second expansion pulse PS3, the pressure chamber 15 starts to expand in volume again. After the maintenance pulse PS22, due to the second expansion pulse PS3 starting from the expansion pulse PS31, the pressure chambers 15 expand in volume, so that negative pressure waves are generated in the pressure chambers 15. As a result of combining the negative pressure waves with the positive pressure waves generated in the pressure chambers 15 due to the first contraction pulse PS2, composite waves are generated.

At the same time, due to the expansion pulse PS31, the tail portion of the ink pushed out from the nozzles 11*e* is retracted toward the nozzles 11*e*. As a result, the ink discharged from each of the nozzles 11*e* due to the first contraction pulse PS2 is forcibly separated from the ink inside the nozzle 11*e* and becomes the fourth droplet. Since the tail portion of the ink is retracted, the tail portion is shortened, so that the satellite accompanying the discharged ink is also reduced. The expanding state at the expansion pulse PS31 is maintained during the maintenance pulse PS32.

Then, due to the contraction pulse PS41 of the second contraction pulse PS4, the pressure chambers 15 contract in volume again. At this time, the ink is pushed again due to the contraction pulse PS41 and the satellite is reduced. This contraction state is maintained during the maintenance pulse PS42. By returning the voltage to the reference voltage due to the pulse PS5, the volume of the pressure chamber 15 returns to the volume in the standby state.

The waveform of the drive signal P is adjusted so that the velocities of the first to fourth droplets are substantially the same at the tip of the liquid column from the nozzle 11*e*. The liquid columnar droplets discharged from the nozzles 11*e* receive air resistance and actions of inertia force. First, the second droplet catches up with and is combined with the first droplet. The third droplet catches up with and is further combined with the combined droplet, and the fourth droplet catches up with and is further combined with the combined droplet. Finally, the combined droplet of the first to fourth droplets lands on a predetermined pixel of the recording medium 50 to form a dot. The droplets discharged by respective pulses may be in a liquid columnar state when combined. In such a case, liquid droplets are combined at the head of the liquid column to form a single droplet, and the single combined droplet lands on a predetermined pixel of the recording medium 50 to form a dot.

Various preferable conditions of the fourth discharge pulse PS as the satellite reducing pulse will now be explained. First, in the fourth discharge pulse PS, the top voltage of the first contraction pulse PS 2 is made higher than the reference voltage. First, in the fourth discharge pulse PS, the top voltage of the first contraction pulse PS2 is made higher than the reference voltage. With such a configuration, it is possible to discharge a droplet larger than the one discharged by the reference voltage, and to suppress occurrence of the satellite.

In the fourth discharge pulse PS, the top voltage of the second contraction pulse PS4 is made higher than the reference voltage. With such a configuration, it is possible to increase the velocity of the droplet (liquid column) at the trailing end so as to reduce the trailing, and to make the droplets are combined together more easily, so that droplet separation and satellite occurrence can be suppressed.

In the fourth discharge pulse PS, the voltage rate VS1:VS2 is preferably 1:1.5. With such a configuration, ink is pushed due to the first contraction pulse PS2 and retracted due to the second expansion pulse PS3, and it is possible to reduce satellites by cutting the discharged droplets effectively. The larger the value of a, which is determined by the equation VS1:VS2=1:$\alpha$, the more the ink vibrates and the more difficult the control of the ink. According to the physical properties of the ink and the like, the rate of VS1:VS2 may be changed.

In the fourth discharge pulse PS, the voltage rate VS1:VS4 is preferably 1:2. With such a configuration, the velocity of the droplet (liquid column) increases at the, so that the discharged droplets are cut effectively and the satellite is reduced. According to the physical properties of the ink and the like, the VS4 may not be needed.

In the fourth discharge pulse PS, the pulse width WS1 of the first expansion pulse PS1 is 1 AL (acoustic length). Such a configuration is preferred since the highest driving efficiency can be exhibited. Further, the pulse width WS1 of the first expansion pulse PS1 may be extended to some extent, for example, it may be from 1 AL to 1.5 AL. Similarly, in the fourth discharge pulse PS, the pulse width WS4 of the second contraction pulse PS4 is 1 AL. Such a configuration is preferred since the highest driving efficiency can be exhibited.

In the fourth discharge pulse PS, the start timing of the second expansion pulse PS3 is within 1 AL from the start of the first contraction pulse PS2. With such a configuration, it is possible to cut and shorten the trailing of the droplet.

In the fourth discharge pulse PS, the start timing of the second contraction pulse PS4 is within 1 AL from the start of the second expansion pulse PS3. With such a configuration, it is possible to increase the velocity of the droplet (liquid column) at the trailing end so as to reduce the trailing.

Further, similar to the fourth discharge pulse PS, the pulse width rate WS2:WS3 is preferably 0.4AL:0.6AL to 0.6AL:0.4AL. With such a configuration, the time T1 is 0.7AL to 0.8AL, from when the meniscus velocity of the ink at the nozzle 11*e* reaches the maximum after application of the first contraction pulse PS2 to when the meniscus velocity reaches the minimum (maximum in the direction opposite to the discharge) after the application of the second expansion pulse PS3. Therefore, due to the time T1 shorter than 1AL, it is possible to effectively cut the discharged droplets with less energy and to reduce the satellite. Since the time T1 is between 0.7AL to 0.8AL from when the meniscus velocity of the ink at the nozzle 11*e* reaches the maximum after the application of the first contraction pulse PS2 to when the meniscus velocity reaches the minimum (maximum in the direction opposite to the discharge) after the application of the second expansion pulse PS3, compared with the case of the standard waveform of the drive signal, it is possible to shorten the time until reaching the minimum and to shorten the time for voltage application. Further, since the time for voltage application can be shortened, compared with the case of the standard waveform, it is possible to effectively cut the discharged droplet while lowering the meniscus velocity at the time of retraction, so that the satellite can be reduced.

In the fourth discharge pulse PS, the meniscus velocity of the ink at the nozzle 11*e* after application of the second expansion pulse PS3 is preferably minimum (maximum in the direction opposite to the discharge) as long as the meniscus can be retracted. With such a configuration, it is possible to cut the discharged droplets effectively and to reduce the satellite.

In the fourth discharge pulse PS, the voltage rate VS1:(VS3-VS4) is preferably from 1:0.5 to 1:1.5, according to the physical properties of the ink. With such a configuration, it is possible to reduce the satellite of the ink and to perform ejection stably.

In the fourth discharge pulse PS, as a result of intensive study by the inventor from the viewpoint of further reducing the satellite generated following the tail portion at the time of forcible separation by the second expansion pulse PS3, the satellite following the tail portion, the time T3 is preferably 1.3AL to 1.7AL, from when the meniscus velocity of the ink at the nozzle 11*e* reaches the maximum after application of the first contraction pulse PS2 to when the meniscus velocity reaches the maximum after application of the second contraction pulse PS4. With such a configuration, it is possible to increase the velocity of the droplet (liquid column) at the trailing end so as to reduce the trailing, and to make the droplets are combined together more easily, so that droplet separation and satellite occurrence can be suppressed.

In the fourth discharge pulse PS, the time T4 is preferably 2.1AL to 2.6AL, from when the meniscus velocity of the ink at the nozzle 11*e* reaches the maximum after application of the first contraction pulse PS2 to when the meniscus velocity reaches the minimum (maximum in the direction opposite to the discharge) due to reverberation after the application of the second expansion pulse PS3. With such a configuration, it is possible to cut the discharged droplets effectively and to reduce the satellite after pushing the ink again due to the second contraction pulse PS4.

In the fourth discharge pulse PS, the meniscus velocity of the ink at the nozzle 11*e* after application of the second contraction pulse PS4 is preferably higher as long as the meniscus does not overflow. With such a configuration, it is possible to improve the velocity of the succeeding droplet so as to reduce the satellite, and to perform stable ejection with small influence on the next droplet.

In the fourth discharge pulse PS, after the meniscus velocity (pressure) of the ink at the nozzle 11*e* due to the reverberation after application of the second contraction pulse PS4 reaches the minimum (maximum in the direction opposite to the discharge), the reverberation is preferably suppressed. With such a configuration, in the case of successively ejecting droplets, it is possible to reduce the influence on the next droplet and to perform stable ejection.

In the fourth discharge pulse PS, it is preferable that the reverberation is suppressed so that the meniscus velocity (pressure) of the ink at the nozzle 11*e* due to the reverberation after application of the second contraction pulse PS4 is 0. With such a configuration, it is possible to shorten the waveform length of the drive signal and to perform driving at high velocity.

Generally, inks having higher surface tension are combined together more easily. It is possible to reduce droplet separation and satellite occurrence with the drive signal of the waveform of the present embodiment even for an ink having low surface tension. Therefore, the driving signal is more effective for the ink having low surface tension. Specifically, it is expected to be effective when the surface tension of the ink is in the range of 20 to 35 [mN/m]. A solvent type ink or a UV ink is preferable to an water-based ink having a relatively high surface tension.

Figure 5:
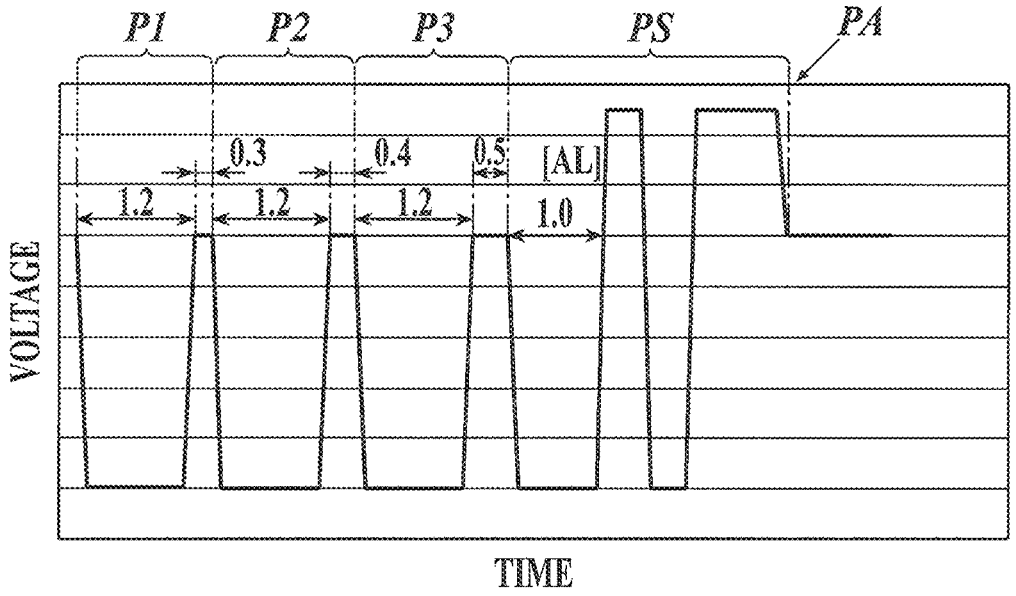
FIG. 5 is a timing chart showing a first drive signal as a First Example.
Figure 6:
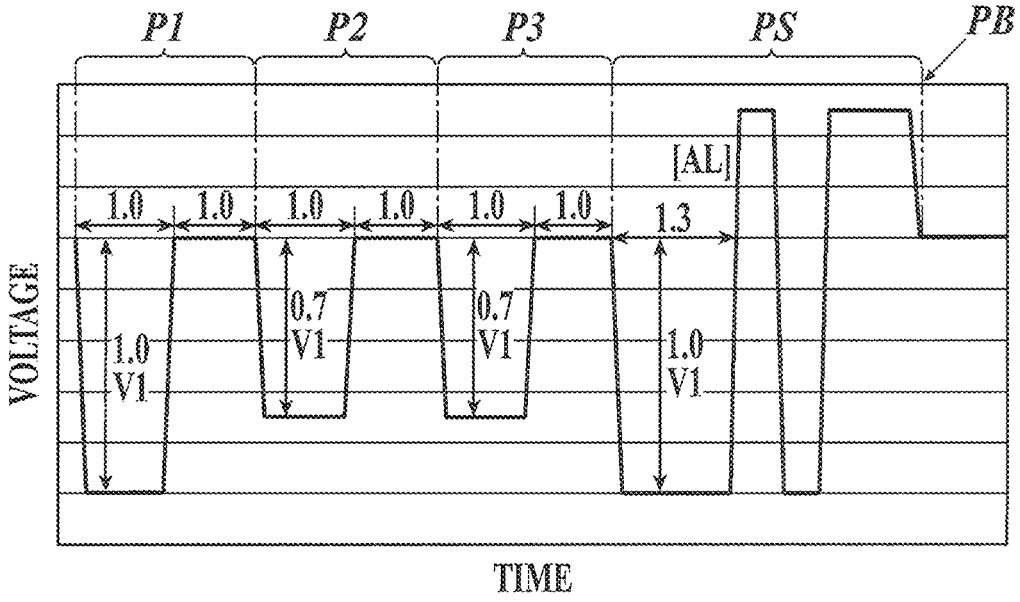
FIG. 6 is a timing chart showing a second drive signal as a Second Example.
Figure 7:
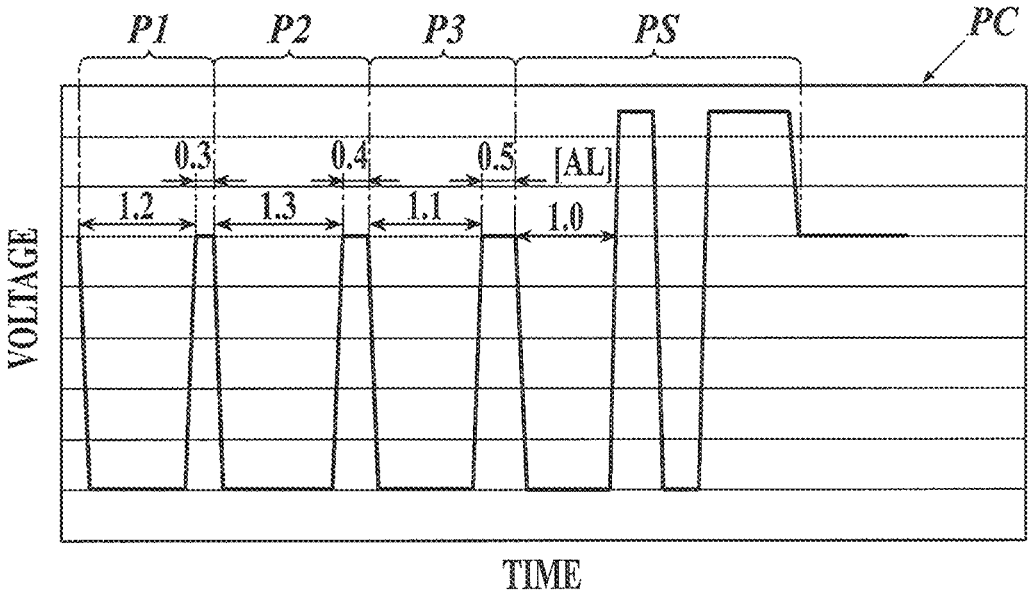
FIG. 7 is a timing chart showing a third drive signal as a Third Example.
Figure 8:
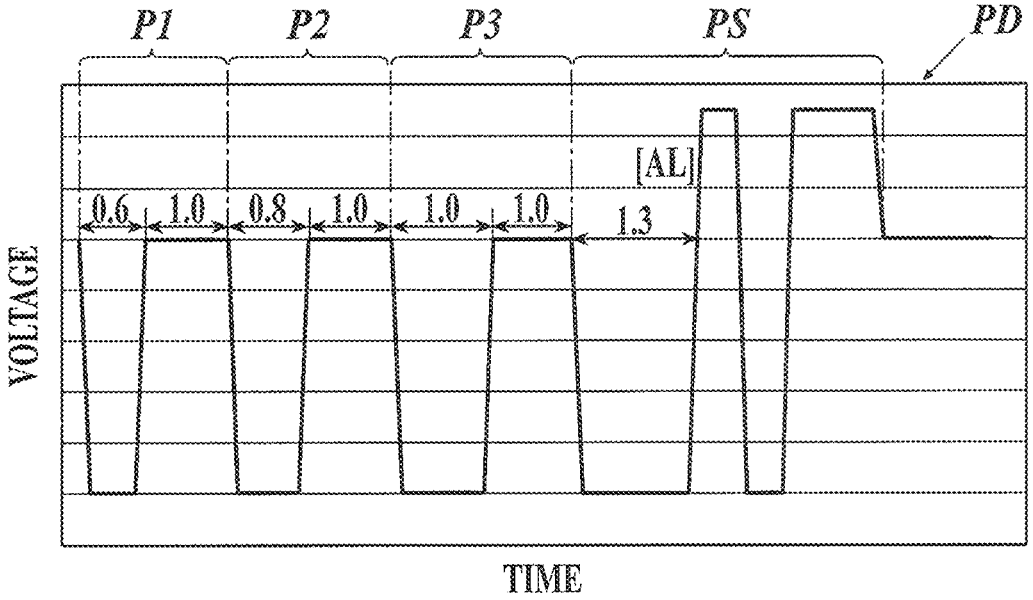
FIG. 8 is a timing chart showing a fourth drive signal as a Comparative Example.

Next, with reference to FIG. 5 to FIG. 8, a waveform of a preferable drive signal for equalizing tip velocities of multiple liquid columns will be explained. FIG. 5 is a timing chart showing the drive signal PA according to the First Example. FIG. 6 is a timing chart showing the drive signal PB according to the Second Example. FIG. 7 is a timing chart showing the drive signal PC according to the Third Example. FIG. 8 is a timing chart showing the drive signal PD according to the Comparative Example.

The velocity (component) of the droplet (liquid column) was measured from each of the drive signal PA of the First Example, the drive signal PB of the Second Example, the drive signal PC of the Third Example, and the drive signal PD of the comparative example. The velocity component of each discharge pulse due to the application of the drive signal to the actuator 16 of each of the ink jet heads 10A, 10B, 10C, and 10D in the ink jet recording apparatus 1 is measured using a strobe camera as follows. The velocity (=distance/time) is calculated by measuring the distance traveled by the tip of the liquid column for 10 [μsec] (before separation) from the time the tip of the liquid column starts to be seen from the nozzle surface (from the start of discharge). Further, the velocity (=distance/time) of the droplet after combination of the droplets each discharged by the discharge pulse of the driving signal is calculated by measuring the distance traveled for 10 [μsec] from the position of 500 [um] from the nozzle surface.

Evaluation criteria for preferable liquid droplets (liquid column) were set as follows.

(1). The velocity component of respective discharge pulses of the drive signal (the velocity at the tip of the liquid columns by the respective discharge pulse) is within ±5%.

(2). The length of satellite is 50 μm or less at the distance of 1 [mm] from the nozzle surface.

With reference to FIG. 5, the drive signal PA as the First Example of the drive signal P will be explained. The drive signal PA includes a first discharge pulse P1, a second discharge pulse P2, a third discharge pulse P3, and a fourth discharge pulse PS. In the drive signal PA, the pulse width W10 of the discharge pulse P10, the pulse width W20 of the ejection pulse P20, and the pulse width W30 of the ejection pulse P30 are set to be an equal value, for example, 1.2 AL (Acoustic Length). AL is a half of the natural vibration frequency period (half cycle) of the channel (pressure chamber 15).

The pulse width W11 of the maintenance pulse P14, the pulse width W21 of the maintenance pulse P24 and the pulse width W31 of the maintenance pulse P34 of the driving signal PA are respectively set to be, for example, 0.3 AL, 0.4 AL, and 0.5 AL. That is, the drive signal PA is a drive signal obtained by adjusting the pulse width of each maintenance pulse as the standby time between the discharge pulses P10, P20, P30, and P40. The pulse widths W11, W21, and W31 of the maintenance pulses P14, P24, and P34 as the standby time between the discharge pulses P10, P20, P30, and P40 gradually increase to 0.5 AL from the pulse width W11 (first standby time) of 0.3 AL, which is of less than 0.5 AL. The standby time to be increased finally is set according to the pulse width W11 of the maintenance pulse P14 of the first standby time, 0.5 AL in this example, but the present invention is not limited thereto. The pulse width W40 of the discharge pulse P40 is set to be 1.0 AL.

In the fourth discharge pulse PS of the drive signal PA, the pulse width WS1 of the first expansion pulse PS1 was 1.0 AL, the pulse width WS2 of the first contraction pulse PS2 was 0.5 AL, the pulse width WS3 of the second expanding pulse PS3 was 0.5 AL, the pulse width WS4 of the second contraction pulse PS4 was 1.0 AL, VS1 was 20 [V], VS2 was 30 [V], VS3 was 30 [V], and VS4 was 10 [V]. The conditions of the fourth discharge pulse PS was the same for the drive signal PB of the Second Example, the drive signal PC of the Third Example, and the drive signal PD of the Comparative Example.

As a result of measuring the velocity component of the drive signal PA, the velocities of the tips of liquid columns of the discharge pulses P10, P20, P30, and P40 were respectively 6.25 [m/s], 6.19 [m/s], 6.08 [m/s], and 6.55 [m/s], and the velocity of the combined droplet of the four droplets was 6.30 [m/s]. This combined droplet had a satellite length of 20 [um] at a distance of 1 [mm] from the nozzle surface. Therefore, the drive signal PA satisfies the evaluation criteria (1) and (2). By adjusting the standby time as in the drive signal PA in this way, the velocity of the tip of each liquid column by each discharge pulse can be made almost the same, the velocity of the droplet by the final discharge pulse is prevented from increasing too much, and the occurrence of satellites can be suppressed. In addition, the occurrence of satellites can be further suppressed by the fourth discharge pulse PS as the satellite reducing pulse.

In the drive signal PA, the pulse width of each of the maintenance pulses P14, P24, and P34 as a standby time between the discharge pulses P10, P20, P30, and P40 may gradually decrease from the pulse width W11 (first standby time) of more than 0.5 AL. The standby time to be decreased finally is set according to the pulse width W11 of the maintenance pulse P14 of the first standby time. With such a configuration, it is possible to discharge ink appropriately (for example, the evaluation criteria (1) and (2) are satisfied).

With reference to FIG. 6, the drive signal PB as the Second Example of the drive signal P will be explained. The drive signal PB includes a first charge pulse P1, a second charge pulse P2, a third discharge pulse P3, and a fourth discharge pulse PS. In the drive signal PB, the pulse width W10 of the discharge pulse P10, the pulse width W20 of the discharge pulse P20, and the pulse width W30 of the discharge pulse P30 are set to be an equal value, for example, 1.0 AL.

In the drive signal PB, the pulse width W11 of the maintenance pulse P14, the pulse width W21 of the maintenance pulse P24, and the pulse width W31 of the maintenance pulse P34 are set to be an equal value, for example, 1.0 AL. In the drive signal PB, the voltage V1 of the discharge pulse P10, the voltage V2 of the discharge pulse P20, the voltage V3 of the discharge pulse P30, and the voltage VS1 of the discharge pulse P40 are respectively set to be, for example, 20 [V], 14 [V] (=0.7V1), 14 [V] (=0.7V1), and 20 [V] (=1.0V1). As the voltage of each discharge pulse increases, the velocity of the droplet also increases. That is, the drive signal PB is set such that the voltages V2 and V3 of the discharge pulses P20 and P30 are smaller than the voltage V1 of the first discharge pulse P10 and that the voltage VS1 of the last discharge pulse P40 is set to be the maximum larger than the voltage V3, for example, equal to the voltage V1 of the first discharge pulse P10. The pulse width W11 of the maintenance pulse P14, the pulse width W21 of the maintenance pulse P24, and the pulse width W30 of the maintenance pulse P34 are set to be equal value, for example, 1.0 AL. Further, the pulse width W40 of the discharge pulse P40 is set to be 1.3 AL.

As a result of measuring the velocity component of the drive signal PB, the velocities of the tips of liquid columns of the discharge pulses P10, P20, P30, and P40 were respectively 6.32 [m/s], 5.88 [m/s], 5.95 [m/s], and 6.40 [m/s], and the velocity of the combined droplet of the four droplets was 6.14 [m/s]. This combined droplet had a satellite length of 10 [um] at a distance of 1 [mm] from the nozzle surface. Therefore, the drive signal PB satisfies the evaluation criteria (1) and (2). In this case, the droplets are made to be combined together easily because the velocities of the tips of the second and third liquid columns are less than the velocity of the tip of the first liquid column, and the velocity of the tip of the fourth liquid column is larger than the velocity of the tip of the third liquid column. By adjusting the pulse width of the discharge pulse as in the drive signal PB in this way, the velocity of the tip of each liquid column by each discharge pulse can be made almost the same, the velocity of the droplet by the final discharge pulse is prevented from increasing too much, and the occurrence of satellites can be suppressed. In addition, the occurrence of satellites can be further suppressed by the fourth discharge pulse PS as the satellite reducing pulse.

In the drive signal PB, the voltage VS1 of the last discharge pulse P40 is larger than the voltage V3, but may not be necessarily the maximum. With such a configuration, it is possible to discharge ink appropriately (for example, the evaluation criteria (1) and (2) are satisfied).

With reference to FIG. 7, the drive signal PC as the Third Example of the drive signal P will be explained. The drive signal PC includes a first charge pulse P1, a second charge pulse P2, a third discharge pulse P3, and a fourth discharge pulse PS. The pulse width W10 of the discharge pulse P10 of the drive signal PB, the pulse width W20 of the discharge pulse P20, and the pulse width W30 of the discharge pulse P30 are respectively set to be 1.2 AL, 1.3 AL, and 1.1 AL, for example.

In the drive signal PC, the pulse width W11 of the maintenance pulse P14, the pulse width W21 of the maintenance pulse P24, and the pulse width W31 of the maintenance pulse P34 are respectively set to be, for example, 0.3 AL, 0.4 AL, and 0.5 AL. In other words, the maximum standby time of each discharge pulse is set to be 0.5 AL. By setting the maximum standby time to be 0.5 AL for each discharge pulse in the drive signal, the number of satellites can be reduced and the stability of the waveform can be enhanced (droplets can be ejected even at a higher velocity). The maximum velocity of the droplet can be increased depending on the standby time of each discharge pulse. Further, the pulse width W40 of the discharge pulse P40 is set to be 1.0 AL.

In the Third Example the pulse width of each discharge pulse and each standby time are determined as follows, for example. Firstly, the standby time of each discharge pulse is each determined to be at most 0.5 AL. Then, the pulse width of each ejection pulse is determined in such a range that the velocity of the tip of each liquid column becomes substantially the same and that meniscus break does not occur due to the too large negative pressure which breaks the ink surface on the nozzle surface. The pulse width of each discharge pulse is determined by the shape of the pressure wave of each discharge pulse for expansion and contraction.

As a result of measuring the velocity component of the drive signal PC, the velocities of the tips of liquid columns of the discharge pulses P10, P20, P30, and P40 were respectively 6.12 [m/s], 6.22 [m/s], 6.15 [m/s], and 6.30 [m/s], and the velocity of the combined droplet of the four droplets was 6.20 [m/s]. This combined droplet had a satellite length of 10 [um] at a distance of 1 [mm] from the nozzle surface. Therefore, the drive signal PC satisfies the evaluation criteria (1) and (2). By adjusting the standby time as in the drive signal PC and further adjusting the pulse width of the discharge pulse according to the standby time in this way, the velocity of the tip of each liquid column by each discharge pulse can be made almost the same, the velocity of the droplet by the final discharge pulse is prevented from increasing too much, and the occurrence of satellites can be suppressed. In addition, the occurrence of satellites can be further suppressed by the fourth discharge pulse PS as the satellite reducing pulse.

With reference to FIG. 8, the drive signal PD as the Comparative Example of the drive signal PD will be explained. The drive signal PD includes a first charge pulse P1, a second charge pulse P2, a third discharge pulse P3, and a fourth discharge pulse PS. In the drive signal PD, the pulse width W10 of the discharge pulse P10, the pulse width W20 of the discharge pulse P20, and the pulse width W30 of the discharge pulse P30 are sequentially set to be, for example, 0.6 AL, 0.8 AL, and 1.0 AL. That is, the pulse widths W11, W21, and W31 of the discharge pulses P10, P20, and P30 are gradually increased so that the velocity of the later droplet is larger.

In the drive signal PD, the pulse width W11 of the maintenance pulse P14, the pulse width W21 of the maintenance pulse P24, and the pulse width W31 of the maintenance pulse P34 are set to be an equal value, for example, 1.0 AL. Further, the pulse width W40 of the discharge pulse P40 is set to be 1.3 AL.

As a result of measuring the velocity component of the drive signal PD, the velocities of the tips of liquid columns of the discharge pulses P10, P20, P30, and P40 were respectively 4.83 [m/s], 5.41 [m/s], 6.66 [m/s], and 7.52 [m/s], and the velocity of the combined droplet of the four droplets was 6.11 [m/s]. This combined droplet had a satellite length of 180 [um] at a distance of 1 [mm] from the nozzle surface. Therefore, the drive signal PA does not satisfy the evaluation criteria (1) or (2). Satellites tend to come out due to the increased velocity of the tip of the liquid column of the fourth discharge pulse PS compared to the velocity of the tip of the other liquid columns in particular.

As a result, satellites occur in spite of the fourth discharge pulse PS as the satellite reducing pulse.

As described above, according to the present embodiment, the ink jet recording apparatus 1 includes the ink jet heads 10A, 10B, 10C, and 10D and the driving circuits 60A, 60B, 60C, and 60D to apply the drive signal P for discharging multiple droplets to one pixel and combining them together, to the ink jet heads 10A, 10B, 10C, and 10D. The drive signal P includes multiple discharge pulses P10, P20, P30, and P40 which make the velocities of the tip of the respective liquid columns substantially the same as each other after a predetermined time from the start of ink discharge at the nozzle 11*e*.

As a result, it is possible to prevent the excessive increase of the velocity of the last droplet due to the sequential increase of the velocity of multiple droplets, to suppress the satellite in the multi drop method, and to improve image quality of a recorded image.

By the drive signal P, while the absolute value of the voltage is kept constant between the bottom voltage and the reference voltage for each of the discharge pulses P10, P20, P30, and P40, the pulse widths W11, W21, and W31 of the maintenance pulses P14, P24, and P34 as the standby time between the discharge pulses P10, P20, P30, and P40 are adjusted. Thereby the speed of the tip of each liquid column is made approximately the same. The drive signal P is set such that, when the pulse width of the maintenance pulse P14 of the first standby time is less than 0.5 AL, the pulse widths W21 and W31 of the maintenance pulses P24 and P34 as the subsequent standby time are successively lengthened (Pulse widths W21, W31 are increased in order). As a result, it is possible to prevent the excessive increase of the velocity of the last droplet due to the sequential increase of the velocity of the droplets, to suppress the satellite in the multi drop method, and to improve image quality of a recorded image. Further, the similar effects can be achieved by setting the pulse widths W21 and W31 of the maintenance pulses P24 and P34 as the subsequent standby time to be sequentially decreased, when the pulse width of the maintenance pulse P14 of the first standby time is 0.5 AL or more.

In the drive signal P, the pulse widths W11, W21, and W31 of the maintenance pulses P14, P24, and P34 of the standby time are all set to be 0.5 AL or less. Depending on the pulse widths W11, W21, and W31, the pulse widths W10, W20, and W30 of the discharge pulses P10, P20, P30, and P40 are set so that the velocities of the tips of the liquid columns are substantially the same and so that the negative pressure does not become too large (so that the meniscus break does not occur). As a result, it is possible to prevent the excessive increase of the velocity of the last droplet due to the sequential increase of the velocity of multiple droplets, to suppress the satellite in the multi drop method, and to improve image quality of a recorded image.

Further, according to the drive signal P, as for the discharge pulses other than the last discharge pulse P40 (as for the discharge pulse P20 and P30), the absolute values of voltages (voltages V1, V2, V3, and V4) from the bottom voltages of the multiple discharge pulses P10, P20, P30, and P40 to the reference voltage are each adjusted so as to be smaller than or equal to the preceding discharge pulse(s). Therefore, the velocity of the tip of each liquid column is made substantially the same. According to the drive signal P, as for the voltage from the bottom voltage of the discharge pulse to the reference voltage, the voltages V2 and V3 of the discharge pulses P20 and P30 after the first discharge pulse P10 are lower than the voltage V1 of the discharge pulse P10. As a result, it is possible to decrease the velocity of the tip of the liquid column by the discharge pulses P20 and P30 following the first discharge pulse P10 than the velocity of the tip of the liquid column by the first discharge pulse P10, to prevent excessive increase of the velocity of the last droplet, to suppress the satellite in the multi drop method, and to improve image quality of a recorded image.

Further, according to the drive signal P, among the voltages of all the discharge pulses P10, P20, P30, and P40, the voltage VS1 by the last discharge pulse P40 is the maximum. Therefore, it is possible to cause multiple droplets to be combined together by increasing the velocity of the tip of the last liquid column, and to improve image quality of a recorded image.

In the driving pulse P, the last discharge pulse P40 is included I the fourth discharge pulse PS as the satellite reducing pulse. The fourth discharge pulse PS sequentially includes the first expansion pulse PS1 which starts from the reference voltage and causes the pressure chamber 15 to expand in volume, the first contraction pulse PS2 which causes the pressure chamber 15 to contract in volume and discharges ink from the nozzle 11*e*, the second expanding pulse PS3 which causes the pressure chamber 15 to expand in volume, and the second contraction pulse PS4 which causes the pressure chamber 15 to contract in volume. In the fourth discharge pulse PS, the top voltage of the first contraction pulse PS2 is higher than the reference voltage, the second expansion pulse PS3 is started within 1 AL from the start of the first contraction pulse PS2, and the second contraction pulse PS4 is started within 1 AL from the start of the second expansion pulse PS3. Therefore, it is possible to discharge a droplet larger than the droplet discharged with the reference voltage, to shorten the droplet by cutting the trail, to reduce the trailing by increasing the velocity of the droplet at the end of the droplet, and to suppress droplet separation and satellite occurrence.

The driving pulse P includes multiple discharge pulses P10, P20, P30, and P40 and the fourth discharge pulse PS as the satellite reducing pulse. The pulse widths W10, W20, W30, and W40 of the multiple discharge pulses P10, P20, P30, and P40 are 1.0 to 1.3 times of AL. The pulse widths W11, W21, and W31 of the maintenance pulses P14, P24, and P34 as the standby time between discharge pulses are 0.3 to 0.5 times of AL. The standby time is sequentially lengthened or has the same length as the preceding one, and the last discharge pulse P40 includes the fourth discharge pulse PS as a satellite reducing pulse. As a result, it is possible to prevent the excessive increase of the velocity of the last droplet due to the sequential increase of the velocity of multiple droplets, to suppress the satellite in the multi drop method, and to improve image quality of a recorded image.

The description in the above embodiment is an example of a preferred ink jet recording apparatus and an ink jet recording method according to the present invention, and does not limit the present invention.

For example, in the fourth discharge pulse PS of the drive signal P of the above embodiment, the top voltage of the second contraction pulse PS4 may be higher than the top voltage of the first contraction pulse PS2. With such a configuration, it is possible to increase the velocity of the droplet (liquid column) at the trailing end so as to reduce the trailing, and to make the droplets are combined together more easily, so that droplet separation and satellite occurrence can be suppressed.

The detailed structure and detailed operation of each part constituting the ink jet recording apparatus 1 in the above embodiment can be appropriately changed without departing from the spirit of the present invention.

According to the present invention, it is possible to reduce the satellite and to improve image quality of a recorded image.

Although embodiments of the present invention have been described and illustrated in detail, the disclosed embodiments are made for purposes of illustration and example only and not limitation. The scope of the present invention should be interpreted by terms of the appended claims.

INDUSTRIAL APPLICABILITY

As described above, the ink jet recording apparatus and the ink jet recording method according to the present invention can be applied image formation on a recording medium.

REFERENCE SIGNS LIST

100 Ink Jet Recording Apparatus
10A, 10B, 10C, 10D Ink Jet Head
11 Head Substrate
11*a* Nozzle Plate
11*b* Intermediate Plate
11*c* Pressure Chamber Plate
11*d* Diaphragm
11*e* Nozzle
12 Wiring Substrate
13 Adhesive Resin Layer
14 Ink Manifold
15 Pressure Chamber
16 Actuator
50 Recording Medium
100 Controller
101 Interface Controller
102 Image Memory
103 Transfer Unit
103*a* Timing Generation Circuit
103*b* Memory Control Circuit
104 CPU
105 Main Scanning Motor
106 Sub-Scanning Motor
107 Input Operation Unit
108 Driving Signal Generating Circuit
60A, 60B, 60C, 60D Drive Circuit
61A, 61B, 61C, 61D Voltage Setting Unit
200 Host Computer

The invention claimed is:

1. An ink jet recording apparatus comprising:

an ink jet head which forms an image on a recording medium in response to a drive signal applied to multiple piezoelectric elements, the drive signal causing multiple pressure chambers corresponding to the multiple piezoelectric elements to expand or to contract in volume and causing ink in the multiple pressure chambers to be discharged from multiple nozzles; and a drive circuit which generates a drive signal for discharging multiple liquid droplets to one pixel for combining the multiple liquid droplets together and applies the drive signal to each of the multiple piezoelectric elements of the ink jet head, wherein the drive signal includes multiple discharge pulses which make velocities of tips of respective liquid columns substantially same after a predetermined time from starting of ink discharge from the nozzles;

wherein, in the drive signal, a last discharge pulse of the multiple discharge pulses is included in a satellite reducing pulse;

wherein, the satellite reducing pulse sequentially includes:

a first expansion pulse which starts from a reference voltage and causes the multiple pressure chambers to expand in volume;

a first contraction pulse which causes the multiple pressure chambers to contract in volume to discharge ink from the multiple nozzles;

a second expansion pulse which causes the multiple pressure chambers to expand in volume; and a second contraction pulse which causes the multiple pressure chambers to contract in volume, wherein a top voltage of the first contraction pulse is higher than the reference voltage, wherein the second expansion pulse is applied within 1 AL from starting of the first contraction pulse, and wherein the second contraction pulse is applied within 1 AL from starting of the second expansion pulse.

2. The ink jet recording apparatus according to claim 1, wherein, in the drive signal, an absolute value of voltage from a bottom voltage to a reference voltage for each of the multiple discharge pulses is kept constant, and wherein the velocities of tips of respective liquid columns is substantially same by adjustment of at least one standby time between the multiple discharge pulses.

3. The ink jet recording apparatus according to claim 2, wherein, in the drive signal, if a first standby time of the at least one standby time is less than 0.5 AL, a subsequent standby time is set to be sequentially longer, and if a first standby time of the at least one standby time is 0.5 AL or more, a subsequent standby time is set to be sequentially shorter.

4. The ink jet recording apparatus according to claim 2, wherein, in the drive signal, all of the at least one standby time between the multiple driving pulses is 0.5 AL or less.

5. The ink jet recording apparatus according claim 1, wherein the velocities of tips of respective liquid columns is substantially same by adjustment of the drive signal, wherein, in the drive signal, an absolute value of voltage from a bottom voltage to a reference voltage for each of the multiple discharge pulses other than a last discharge pulse is adjusted so as to be equal to or less than the absolute value of a preceding discharge pulse.

6. The ink jet recording apparatus according to claim 5, wherein, in the drive signal, a voltage of a discharge pulse after a first discharge pulse of the multiple discharge pulses is lower than a voltage of the first discharge pulse.

7. The ink jet recording apparatus according to claim 6, wherein, in the drive signal, among all voltages from a bottom voltage to a reference voltage for the multiple discharge pulses, a voltage for a last discharge pulse of the multiple discharge pulses is the largest.

8. An ink jet recording apparatus comprising:

an ink jet head which forms an image on a recording medium in response to a drive signal applied to multiple piezoelectric elements, the drive signal causing multiple pressure chambers corresponding to the multiple piezoelectric elements to expand or to contract in volume and causing ink in the multiple pressure chambers to be discharged from multiple nozzles; and a drive circuit which generates a drive signal for discharging multiple liquid droplets to one pixel for combining the multiple liquid droplets together and applies the drive signal to each of the multiple piezoelectric elements of the ink jet head, wherein the drive signal includes multiple discharge pulses which make velocities of tips of respective liquid columns substantially same after a predetermined time from starting of ink discharge from the nozzles, wherein, in the drive signal, a last discharge pulse of the multiple discharge pulses is included in a satellite reducing pulse, wherein, the drive signal includes the multiple discharge pulses and the satellite reducing pulse, wherein a pulse width of the respective multiple discharge pulses is 1.0 to 1.3 times of AL, wherein a standby time between one of the multiple discharge pulses and another of the multiple discharge pulses is 0.3 to 0.5 times of AL, wherein a standby time is longer than or has a same length as a preceding standby time, and wherein a last discharge pulse of the multiple discharge pulses includes a satellite reducing pulse.

9. An ink jet recording method comprising:

forming an image on a recording medium in response to a drive signal applied to multiple piezoelectric elements, causing multiple pressure chambers corresponding to the multiple piezoelectric elements to expand or to contract in volume and causing ink in the multiple pressure chambers to be discharged from multiple nozzles; and generating a drive signal for discharging multiple liquid droplets to one pixel for combining the multiple liquid droplets together and applying the drive signal to each of the multiple piezoelectric elements of the ink jet head, wherein the drive signal includes multiple discharge pulses which make velocities of tips of respective liquid columns substantially same after a predetermined time from starting of ink discharge from the nozzles;

wherein, in the drive signal, a last discharge pulse of the multiple discharge pulses is included in a satellite reducing pulse;

wherein, the satellite reducing pulse sequentially includes:

a first expansion pulse which starts from a reference voltage and causes the multiple pressure chambers to expand in volume;

a first contraction pulse which causes the multiple pressure chambers to contract in volume to discharge ink from the multiple nozzles;

a second expansion pulse which causes the multiple pressure chambers to expand in volume; and a second contraction pulse which causes the multiple pressure chambers to contract in volume, wherein a top voltage of the first contraction pulse is higher than the reference voltage, wherein the second expansion pulse is applied within 1 AL from starting of the first contraction pulse, and wherein the second contraction pulse is applied within 1 AL from starting of the second expansion pulse.

10. The ink jet recording method according to claim 9, wherein, in the drive signal, an absolute value of voltage from a bottom voltage to a reference voltage for each of the multiple discharge pulses is kept constant, and wherein the velocities of tips of respective liquid columns is substantially same by adjustment of at least one standby time between the multiple discharge pulses.

11. The ink jet recording apparatus according to claim 10, wherein, in the drive signal, if a first standby time of the at least one standby time is less than 0.5 AL, a subsequent standby time of the at least one standby time is sequentially lengthened, and if a first standby time of the at least one standby time is 0.5 AL or more, a subsequent standby time of the at least one standby time is sequentially shortened.

12. An ink jet recording method comprising:

forming an image on a recording medium in response to a drive signal applied to multiple piezoelectric elements, causing multiple pressure chambers corresponding to the multiple piezoelectric elements to expand or to contract in volume and causing ink in the multiple pressure chambers to be discharged from multiple nozzles; and generating a drive signal for discharging multiple liquid droplets to one pixel for combining the multiple liquid droplets together and applying the drive signal to each of the multiple piezoelectric elements of the ink jet head, wherein the drive signal includes multiple discharge pulses which make velocities of tips of respective liquid columns substantially same after a predetermined time from starting of ink discharge from the nozzles, wherein, in the drive signal, a last discharge pulse of the multiple discharge pulses is included in a satellite reducing pulse, wherein, the drive signal includes the multiple discharge pulses and the satellite reducing pulse, wherein a pulse width of the respective multiple discharge pulses is 1.0 to 1.3 times of AL, wherein a standby time between one of the multiple discharge pulses and another of the multiple discharge pulses is 0.3 to 0.5 times of AL, wherein a standby time is longer than or has a same length as a preceding standby time, and wherein a last discharge pulse of the multiple discharge pulses includes a satellite reducing pulse.

* * * * *